US007739835B2

(12) United States Patent
Levine

(10) Patent No.: US 7,739,835 B2
(45) Date of Patent: Jun. 22, 2010

(54) OPENING DEVICE

(76) Inventor: Steven Levine, 333 Mamaroneck Ave., #235, White Plains, NY (US) 10605

( * ) Notice: Subject to any disclaimer, the term of this patent is extended or adjusted under 35 U.S.C. 154(b) by 0 days.

(21) Appl. No.: 11/303,732

(22) Filed: Dec. 16, 2005

(65) Prior Publication Data

US 2006/0137247 A1 Jun. 29, 2006

Related U.S. Application Data

(60) Provisional application No. 60/636,825, filed on Dec. 16, 2004.

(51) Int. Cl.
*E05F 11/00* (2006.01)

(52) U.S. Cl. ..... 49/278; 49/276; 49/263

(58) Field of Classification Search ..... 49/276, 49/278, 263, 270, 273, 274; 312/319.9, 319.1, 312/139; 292/DIG. 72, 255; 16/DIG. 7
See application file for complete search history.

(56) References Cited

U.S. PATENT DOCUMENTS

| | | | | | |
|---|---|---|---|---|---|
| 762,729 | A * | 6/1904 | Lee | 49/263 |
| 854,262 | A * | 5/1907 | Young | 49/272 |
| 1,244,910 | A * | 10/1917 | Smith | 292/341.15 |
| 3,012,837 | A * | 12/1961 | Morrissey, Jr. | 49/276 |
| 3,364,621 | A * | 1/1968 | Erickson | 49/263 |
| 4,911,508 | A * | 3/1990 | Tillman | 312/319.9 |
| 5,622,416 | A * | 4/1997 | Rainey et al. | 312/319.9 |
| 6,328,392 | B1 * | 12/2001 | Whitcomb | 312/319.9 |

* cited by examiner

*Primary Examiner*—Gregory J. Strimbu
(74) *Attorney, Agent, or Firm*—Thomas A. O'Rourke; Bodner & O'Rourke, LLP

(57) ABSTRACT

An opening mechanism having a cover assembly, a base mounting plate, and a lever member. The lever member has a first arm and a second arm, which pivot from a first position to a second position. The movement of the arms from the first position to the second position causes one of the arms to move a closure from a closed position to an open position.

18 Claims, 5 Drawing Sheets

OPENING DEVICE

This application claims priority on U.S. Provisional Application Ser. No. 60/636,825 filed Dec. 16, 2004, the disclosures of which are incorporated herein by reference.

FIELD OF INVENTION

The invention relates to a hands-free device for conveniently and easily opening an article such as a door or cover and the like. More particularly the present invention is directed to a door opener device which may be activated readily with one's foot, body or hand.

BACKGROUND OF THE INVENTION

There may come a time in a person's life where it is almost impossible to open a door; generally caused by the lack of a free hand. In one instance this may be the result of carrying, for example, groceries, clothes or other types of packages. In order to open the door, one would have to put whatever they were carrying down and pull the door open. In another instance, one may be cooking and working with a product that may cause cross contamination, such as raw chicken, or beef. When working with such food it is important to wash one's hands before touching other objects, such as the handle on a door of lets say a refrigerator or pantry. Prior art opening devices tend to be complex mechanical devices. One prior art foot operated device is used for opening a lid to a waste receptacle. There is a foot operated member that is depressed. A linkage is operated by the depression of the member. The linkage causes a lid to be raised for use.

A basic lever (from old French levier, the agent noun to lever "to raise") is a rigid object that is used with an appropriate fulcrum or pivot point to multiply the mechanical force that can be applied to another object. This is also termed mechanical advantage, and is one example of the principle of moments. The principle of leverage can also be derived using Newton's laws of motion and modern statics. Levers have been around for centuries, from the ancient Egyptians, who used the levers to move and uplift obelisks weighing more than 100 tons, to the modern construction worker, who use levers for a variety of different tasks every day.

In normal operation the force applied (at end points of the lever) is proportional to the ratio of the length of the lever arm measured between the fulcrum and the application point of the force applied at each end of the lever. There are three types of levers, and all follow this same principle: First class levers, as in the present invention, which include, seesaw, crowbar, pliers, scissors, oar, wheel and axle, trebuchet; Second class levers, which include, wheelbarrow, and nutcracker; Third class levers, which include, human arm, tongs, catapult and fishing rod, hoe, rake, baseball bat, and broom.

OBJECTS OF INVENTION

It is an object of the invention to provide an opening device for opening an article.

It is an object of the invention to provide a device for opening a door, cover or the like.

It is an object of the present invention to provide a door opener which will allow one to open a door without the use of one's hand.

It is another object of the present invention to provide an automatic door opener that is inexpensive to manufacture and easy to install.

It is still another object of the present invention to provide an automatic door opener that provides a means for opening a door with minimum effort on the part of the user.

SUMMARY OF INVENTION

In the present invention a lever mechanism is mounted on a floor, wall or other surface. The lever mechanism has a first end and a second end that are generally transverse to each other. As one end of the lever mechanism is activated, usually by applying force to the end, the opposite end moves outwardly forcing the article to be opened. In a preferred embodiment, one end of the lever mechanism is positioned behind the door to be opened, usually the body of the object the door is used with. Some examples of where the door opener mechanism of the present invention may be of use are: cabinets, appliance doors, and closet doors, etc. These examples are for illustrative purposes and are in no way to be viewed as limiting.

BRIEF DESCRIPTION OF INVENTION

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
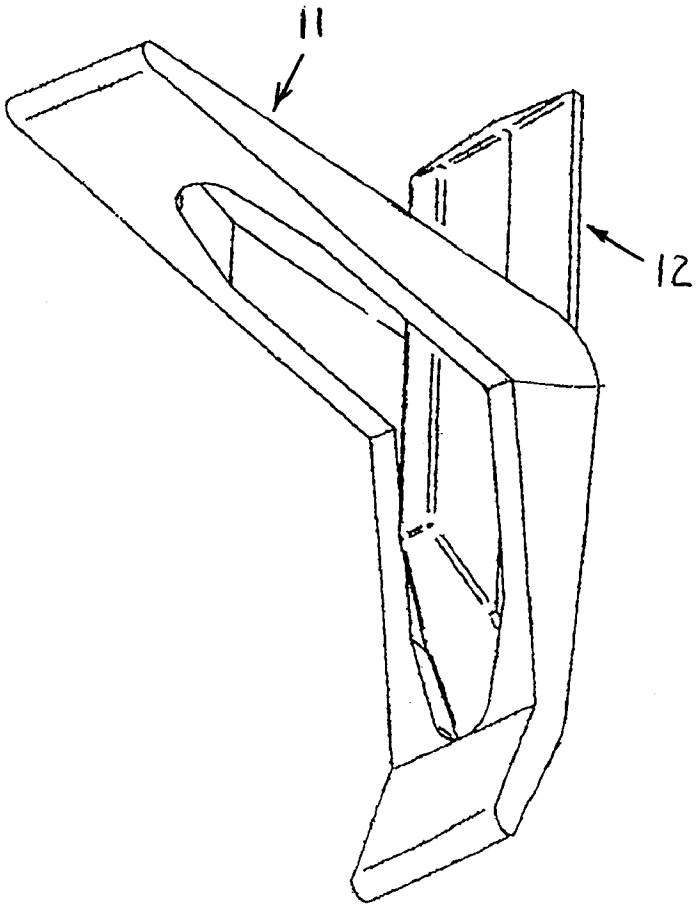
FIG. 2 is a perspective view of the opener device of the present invention after opening an article.
Figure 1:
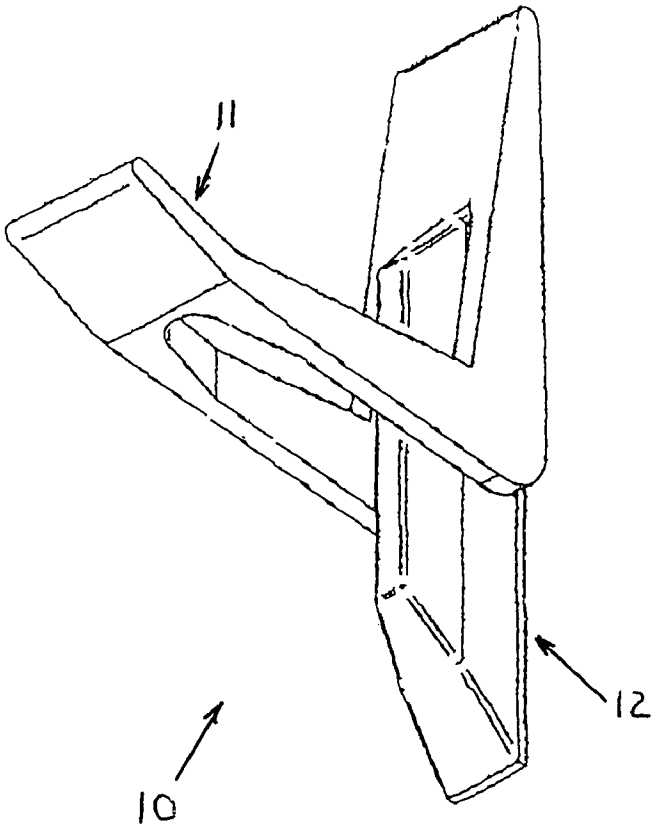
FIG. 1 is a perspective view of the opener device of the present invention ready to open an article.

The door opener mechanism 10 of the present invention includes a lever member 11, and a cover assembly 12, as seen in FIGS. 1 and 2. Cover assembly 12 is comprised of a cover 46 and a base mounting plate 13.

Lever 11 has a generally "L" shape, as seen in FIG. 2. The lever 11 has a first arm 14 and a second arm 15. The first and second arms are generally at about right angles to each other, although there can be other angles that will work as well, depending on the length of the arms and the amount of movement that each arm must undergo to open an article. At each end of the arms 14 and 15 there is a plate portion 16 and 22 respectively. Plate portion 16 is generally positioned between, under or on the side of the article to be opened and whatever the article is being held closed against. The plate portion 16 has a top surface 18 that is generally in the same plane as the top surface 19 of the arm 14. Arm 14 and plate portion 16 are shown with a top surface 19 and 18 respectively and a rear surface 20 that meet in an apex 21. While the arm and plate portion have a generally triangular cross section, other configurations are possible. For example, the arm 14 and plate portion 16 can be a relatively thin stiff member or curved member if desired.

Arm 15 ends in plate portion 22. While arm 15 and plate portion 22 can have the same configuration as arm 14 and plate portion 16, it is preferred that plate portion 22 be slightly angled upwardly for ease of use.

Arm 14 has two sections, a first leg 23 and a second leg 24. The legs 23 and 24 are connected to respective legs 25 and 26 on arm 15. The legs of each arm meet at center section 27 and 28. The legs of each arm form a generally open area 29. Between the arms in the generally open area 29, the housing or cover assembly 12 is positioned to hide the mechanism and provide a clean look to the device. The article of the present invention is preferably secured to a surface by means of the base mounting plate 13. The base mounting plate 13 may have a plurality of orifices 17 to assist in securing the plate to a surface by means of screws, nails, bolts, etc. The opening device itself may similarly be mounted to a surface by any suitable means, including but not limited to adhesive bonding of the base plate 13 to the surface.

Figure 7:
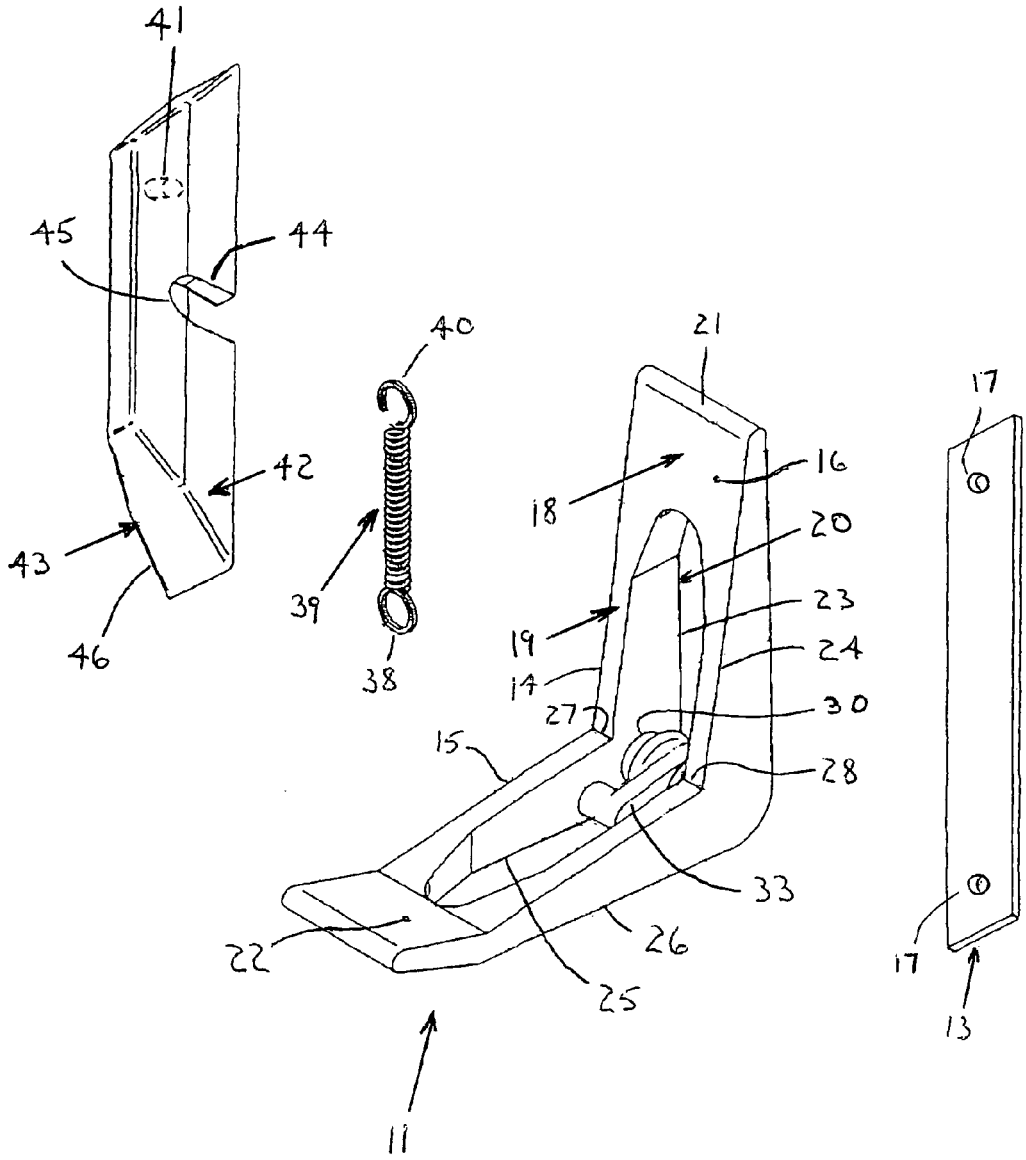
FIG. 7 is an exploded view of the opener device of the present invention.
Figure 10:
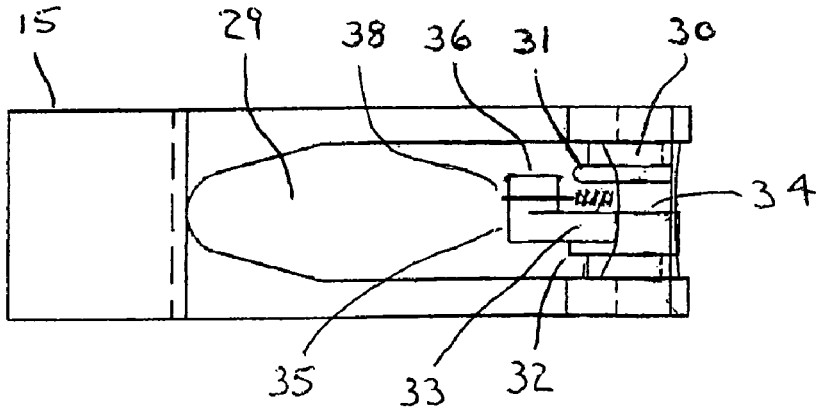
FIG. 10 is an end view of the mechanism of FIG. 9.
Figure 11:
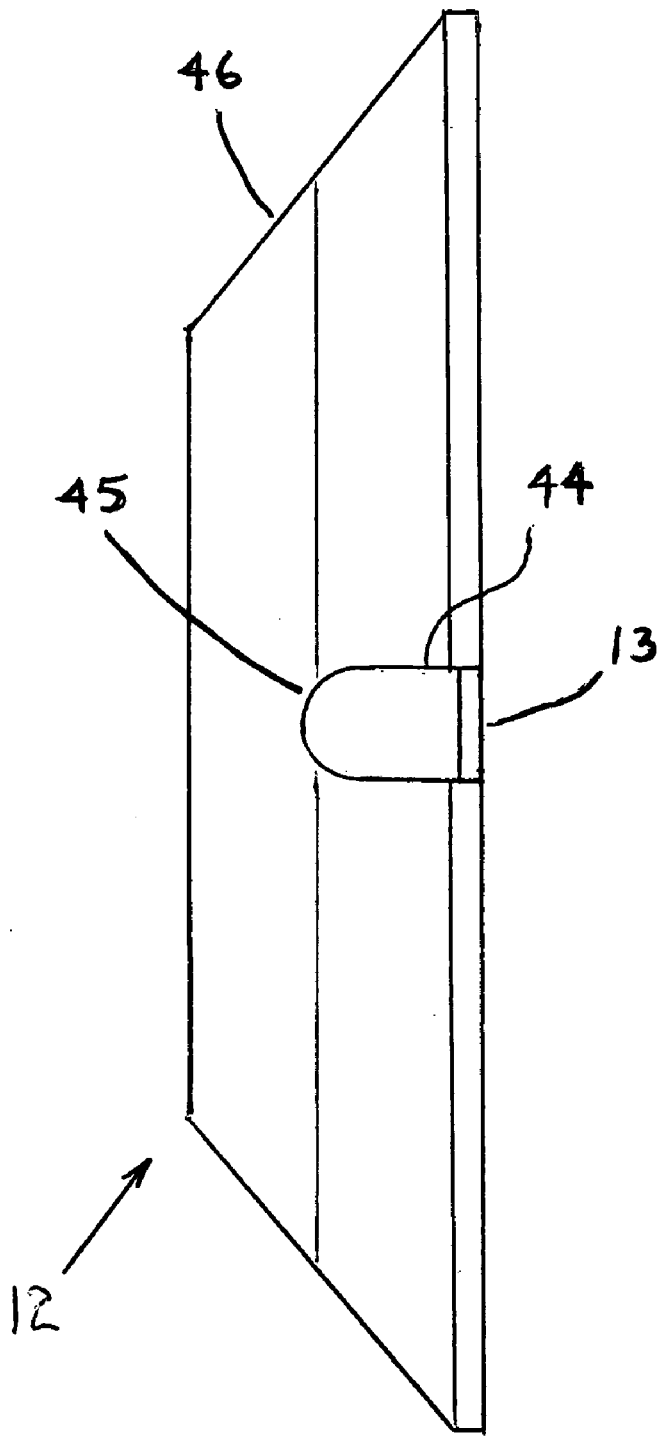
FIG. 11 is a view of the cover assembly.

As seen in FIG. 7 and FIG. 10 underneath the cover assembly 12, the lever member 11 is rotatable about an axle 30. The axle may extend from one leg to the other leg or there can be two axles that the legs pivot about. The axle(s) have a pair of raised rings 31 and 32 extending from the axle and secured thereto. The rings are generally of a greater diameter than the axle 30. The cover 46 of cover assembly 12 has holes 45 with slotted openings 44, where the cover 46 preferably snaps over and retains the axle within holes 45 (see FIGS. 10 and 11), and the rings 31 and 32 help secure the cover assembly 12 to the lever member 11.

Also connected to the axle 30 usually between the two rings 31 and 32 is a tension arm 33. If there are two axles there can be a single ring on one axle and the arm can extend from the other axle. The tension arm 33 moves as the lever member moves. One end 34 of the tension arm 33 is secured to the axle 30. The other end 35 has an extension 36 extending at generally a right angle from the arm end 35 to a portion of the interior sidewall 37 of one of the legs of the lever arm 15. Attached to extension 36 is one end 38 of a spring 39, as shown in FIG. 10. The other end 40 of the spring 39 may be secured to an inside surface of the cover assembly. Alternatively, the cover assembly may have an axle, rod or pin 41 extending from one side wall 42 to the other side wall 43, and the second end 40 of the spring 39 may be secured to the pin 41. The article of the present invention is shown in an "at rest" position in FIG. 1. In this view, arm 15 extends generally outwardly from the door or other article to be opened. Arm 14 is positioned behind a portion of the door. As the arm 15 is moved, in this example, downwardly, arm 14 moves outwardly. The outward movement causes the door to be pushed outwardly as well, thereby opening the door.

As arm 15 moves downwardly or outwardly, the spring 39 expands as the tension arm 33 moves along with arm 15. Since the end 40 of the spring 39 is secured to the cover 46, the movement of tension arm 33 expands the spring as seen in FIG. 9. When the door or other article is opened, the spring 39 retracts to its at rest position when the force is released, thus causing the arm 15 to return to its original position, as seen in FIG. 8.

The cover being positioned between the two legs of each arm does not interfere with the movement of the lever member. As each arm of the lever moves toward the cover, the legs pass on either side of the cover. This provides a lower profile assembly than might otherwise be achieved, while housing the spring and tension arm entirely within said cover assembly throughout the range of motion of the lever arms.

Figure 3:
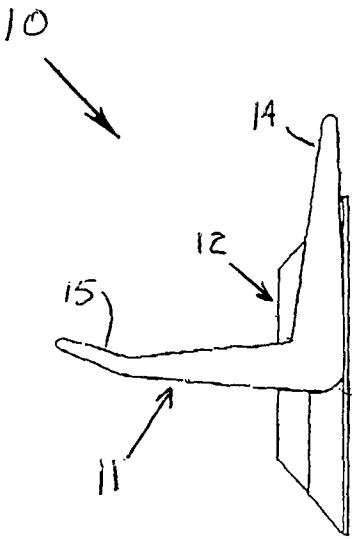
FIG. 3 is a side view of the opener of the present invention ready to open an article.
Figure 4:
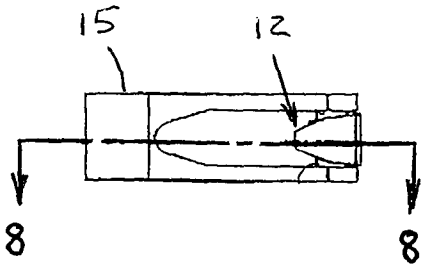
FIG. 4 is an end view of the door opener of FIG. 3.
Figure 5:
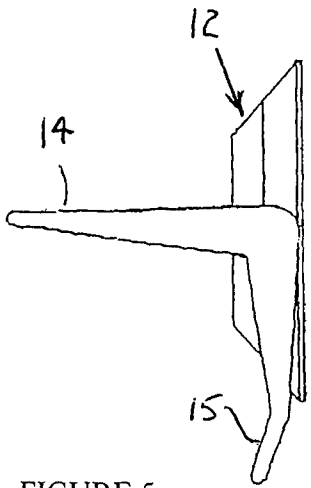
FIG. 5 is a side view of the opener of the present invention after opening an article.
Figure 6:
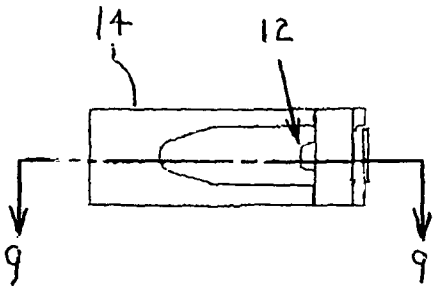
FIG. 6 is an end view of the door opener of FIG. 5.

FIGS. 1 and 3 show the configuration of the opener of the present invention ready to open an article. As the arm is moved downwardly, the other arm moves outwardly. As seen in FIG. 8, the spring 39 is in a resting position in this configuration.

Figure 8:
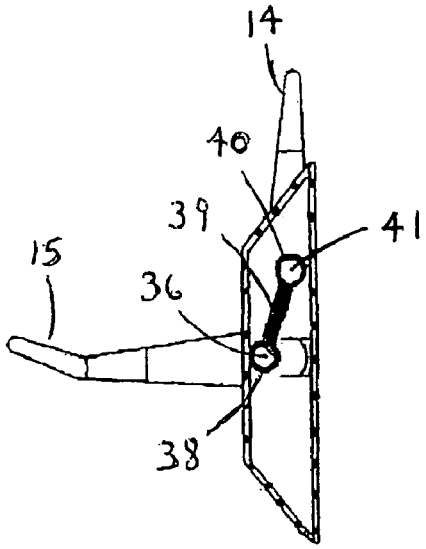
FIG. 8 is cross-sectional view of the opener of FIG. 4 taken along 8-8.
Figure 9:
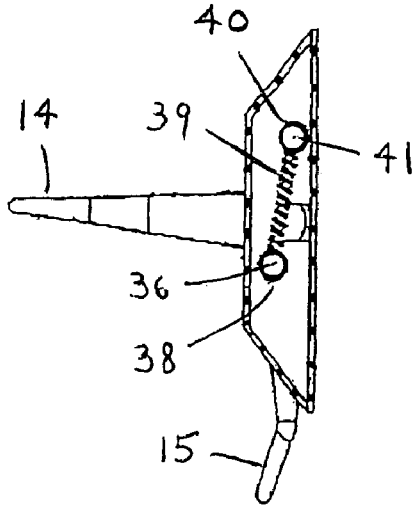
FIG. 9 is a cross-sectional view of the opener of FIG. 6 taken along 9-9.

When the lever members pivots 90 degrees as seen in FIG. 8 and 9, the spring 39 extends as seen in FIG. 9. The spring forces the arms to pivot back to their original position when the force is removed from the arm.

I claim:

1. An opening mechanism comprising a base mounting plate, a cover, a lever member and a tension spring, a first end of said spring being connected to said cover and a second end of said spring being connected to a tension arm mounted to and rotatable with an axle of said lever member, said lever member having a first lever arm and a second lever arm, said first and second lever arms being attached to and rotatable with said axle, said axle being pivotally mounted to said cover, said lever arms adapted to rotate from a first position to a second position, the movement of said lever arms from said first position to said second position causing said tension arm mounted to said axle to rotate with said axle, thereby causing said spring to extend from a first position to a second position, said spring causing said lever arms to return to said lever arm first position when said spring returns to said spring first position, said movement of said lever arms from said lever arm first position to said lever arm second position causing one of said lever arms to cause a closure to move from a closed position to an open position, said spring and said tension arm are disposed within said cover when said lever arms are in said first lever arm position and when said lever arms are in said second lever arm position, and said cover is partially disposed within an opening defined by one of said lever arms.

2. The mechanism according to claim 1 wherein said first lever arm extends from said second lever arm at an approximately 90 degree angle.

3. The mechanism according to claim 2 wherein said lever member pivots about an axis.

4. The mechanism according to claim 3 wherein each of said first and second lever arms has a first leg and a second leg, said first leg of said first lever arm being connected to one of said legs of said second lever arm, and said second leg of said first lever arm being connected to said other of said legs of said second lever arm.

5. The mechanism according to claim 4 wherein said first and second legs of said one of said lever arms form said opening.

6. The mechanism according to claim 5 wherein said member's first lever arm and said second lever arm are joined to said axle and said tension arm extends from said axle, said axle having an end thereof secured to an inner sidewall of one of said legs.

7. The mechanism according to claim 6 wherein said tension arm has an extension extending from an end of said tension arm at a generally right angle to a longitudinal axis of said tension arm.

8. The mechanism according to claim 7 wherein said second end of said spring is secured to said extension of said tension arm.

9. The mechanism according to claim 8 wherein said second end of said spring is secured to a pin extending from an inside wall of said cover.

10. The mechanism according to claim 8 wherein said cover has an inner wall and an outer wall and said first end of said spring is secured to said inner wall of said cover.

11. The mechanism according to claim 10 wherein said spring has a ring on at least one of said ends thereof.

12. The mechanism according to claim 11 wherein said spring has a ring at the other of said ends thereof.

13. The mechanism according to claim 12 wherein said ring of said first end of said spring is positioned over a pin extending from said inner wall of said cover.

14. The mechanism according to claim 13 wherein said extension of said tension arm comprises a pin extending from an end opposite said axle.

15. The mechanism according to claim 14 wherein said ring of said second end of said spring is positioned over said pin of said tension arm.

16. The mechanism according to claim 5 wherein said cover remains stationary when said lever arms move between said first lever arm position and said second lever arm position.

17. The mechanism according to claim 5 wherein said legs each have a top surface, a bottom surface, a first side surface and a second side surface, said opening extending from said top surface of said legs of said one of said lever arms to said bottom surface of said legs of said one of said lever arms.

18. The mechanism according to claim 4 wherein said first leg of said first lever arm and said one of said legs of said second lever arm form an approximately right angle.

* * * * *